US006606592B1

(12) United States Patent
Cho et al.

(10) Patent No.: US 6,606,592 B1
(45) Date of Patent: Aug. 12, 2003

(54) VARIABLE DIMENSION SPECTRAL MAGNITUDE QUANTIZATION APPARATUS AND METHOD USING PREDICTIVE AND MEL-SCALE BINARY VECTOR

(75) Inventors: Yong-duk Cho, Guildford (GB); Moo-young Kim, Seongnam (KR)

(73) Assignee: Samsung Electronics Co., Ltd. (KR)

( * ) Notice: Subject to any disclaimer, the term of this patent is extended or adjusted under 35 U.S.C. 154(b) by 535 days.

(21) Appl. No.: 09/584,107

(22) Filed: May 31, 2000

(30) Foreign Application Priority Data

Nov. 17, 1999 (KR) ..... 99-51066

(51) Int. Cl.[7] ..... G10L 19/06
(52) U.S. Cl. ..... 704/219; 704/222; 704/501
(58) Field of Search ..... 704/200, 219, 704/220, 222, 223, 261, 262, 501, 504

(56) References Cited

U.S. PATENT DOCUMENTS 5,226,084 A * 7/1993 Hardwick et al. ..... 704/219
5,327,520 A * 7/1994 Chen ..... 704/219
5,384,891 A * 1/1995 Asakawa et al. ..... 704/220
6,018,707 A * 1/2000 Nishiguchi et al. ..... 704/222

OTHER PUBLICATIONS

R. J. McAulay, et al., "Sinusoidal Coding," Speech Systems Technology Group, 1995, pp. 121–174;.
P. C. Meuse, "A 2400 bps Multi–Band Excitation Vocoder," Proc. Int. Conf. on Acoust., Speech, Signal Processing, 1990, pp. 9–12.
M. Nishiguchi, et al., "Vector Quantized MBE with Simplified V/UV Decision at 3.0 kbps," in Proc. Int. Conf. on Acoust., Speech, Signal Processing, 1993, pp. II–151–154.
A. Das, et al., "Variable–Dimension Vector Quantization," IEEE Signal Processing Letters, vol. 3, pp. 200–202, Jul. 1996.
P. Lupini, et al., "Vector Quantization of Harmonic Magnitude for Low–Rate Speech Coders," in Proc. Int. Conf. on Acoust., Speech, Signal Processing, 1994, pp. 858–862.
"INMARSAT M Voice Codec," Digital Voice Systems, Inc., Version 1.7, Sep. 13, 1991, pp. 1–143.

* cited by examiner

*Primary Examiner*—Daniel Abebe
(74) *Attorney, Agent, or Firm*—Burns, Doane, Swecker & Mathis, LLP

(57) ABSTRACT

A variable dimension spectral magnitude quantization apparatus and method using a predictive and mel scale binary vector is provided. The apparatus according to linear prediction spectral envelope and residual spectral envelope quantization using low order linear prediction modeling and residual spectrum modeling, includes a predictive quantizer for obtaining a predictive-quantized first residual spectral envelope from a quantized previous residual spectral envelope, a mel-scale binary vector quantizer for obtaining a second residual spectral envelope represented with a linear scale code vector using a mel-scale binary vector codebook, a synthesized spectral envelope generator for adding the output of the predictive quantizer and the output of the mel-scale binary vector quantizer to generate a quantized residual spectral envelope and multiplying the quantized residual spectral envelope by a corresponding quantized linear prediction spectral envelope to generate a synthesized spectral envelope, a comparator for comparing the synthesized spectral envelope with an original spectral envelope, and a minimum value detector for detecting a minimum value from the values sequentially obtained by the comparator.

11 Claims, 3 Drawing Sheets

VARIABLE DIMENSION SPECTRAL MAGNITUDE QUANTIZATION APPARATUS AND METHOD USING PREDICTIVE AND MEL-SCALE BINARY VECTOR

BACKGROUND OF THE INVENTION

1. Field of the Invention

The present invention relates to speech coding, and more particularly, to a variable dimension spectral magnitude quantization apparatus and method using a predictive and mel-scale binary vector.

2. Description of the Related Art

The quantization of spectral magnitudes is a crucial issue in sinusoidal speech coding to obtain high quality low bit rate speech. There are two representative methods of quantizing a spectral magnitude. One is a method of quantizing a linear prediction (LP) spectral envelope using high order LP modeling and the other is a method of quantizing a LP spectral envelope and a residual spectral envelope using low order LP modeling and residual spectrum modeling. According to the former method, even though the order and the number of quantization bits increase, the improvement of performance converges into a consistent value, and the amount of computation or memory requirement is considerable. Accordingly, it is desired that a quantization method needing a small amount of computation or memory while improving the quality of speech is implemented with the application of the latter method.

The dimension of spectral magnitude is variable as it is sampled and estimated at the pitch harmonics. Several techniques have been suggested to quantize the spectral magnitude of variable dimension. A multiband excitation vocoder transforms a spectral magnitude into the coefficients of a discrete cosine transform, and then quantizes the coefficients using the combination of scalar and vector quantizers (DVSI, *INMARSAT M Voice Codec,* vol. 1.7. Digital Voice Systems Inc., September 1991). A sinusoidal transform coder represents a spectrum with the all-pole model of high order (R. J. McAulay and T. F. Quati, "Sinusoidal Coding", in Speech coding and synthesis (W. B. Kleijn and K. K. Paliwal, eds.), pp. 121–174, Amsterdam, The Netherlands: Elsevier, 1995). In band-limited interpolation (BLI), the variable-dimension of the spectrum is converted into a fixed-dimension based on sampling rate conversion and signal interpolation techniques (P. C. Meuse, "A 2400 bps Multi-Band Excitation Vocoder", in Proc. Int. Conf. on Acoust., Speech, Signal Processing, pp. 9–12, 1990, and M, Nishiguchi, J. Matsumoto, R. Wakatsuki, and S. Ono, "Vector Quantized MBE with Simplified V/UV Decision at 3.0 kbps", in Proc. Int. Conf. on Acoust., Speech, Signal Processing, pp. II 151–154, 1993). In variable-dimension vector quantization (VDVQ), a spectral vector is quantized directly using a universal codebook of a fixed-dimension (A. Das, V. Rao, and A. Gersho, "Variable-Dimension Vector Quantization", IEEE Signal Processing Letters, vol. 3 , pp. 200–202, July 1996). In non-squared transform vector quantization (NSTVQ), an input vector is transformed into a fixed dimension using a linear transform matrix (P. Lupini and V. Cuperman, "Vector Quantization of Harmonic Magnitude for Low-Rate Speech Coders", in Proc. Int. Conf. on Acoust., Speech, Signal Processing, pp. 858–862, 1994).

To obtain high spectral accuracy, however, these conventional techniques require not only a huge memory and a training step to keep and obtain the vector codebook, but also considerable search time to find an optimal code vector.

SUMMARY OF THE INVENTION

To solve the above problems, it is a first objective of the present invention to provide a variable dimension spectral magnitude quantization apparatus using a predictive and mel-scale binary vector, which quantizes a spectral magnitude with very low computational complexity and achieves high spectral accuracy by efficiently quantizing a residual spectral envelope using a predictive and mel-scale binary vector quantizer.

It is a second objective of the present invention to provide an apparatus for efficiently quantizing a residual spectral envelope in a variable dimension spectral magnitude quantization apparatus.

It is a third objective of the present invention to provide a method for efficiently quantizing a residual spectral envelope using predictive and mel-scale binary vector quantization in a procedure of a variable dimension spectral magnitude quantization.

It is a fourth objective of the present invention to provide a variable dimension spectral magnitude quantization method performed by the variable dimension spectral magnitude quantization apparatus.

Accordingly, to achieve the first objective, there is provided a variable dimension spectral magnitude quantization apparatus including a predictive quantizer for obtaining a predictive-quantized first residual spectral envelope from a quantized previous residual spectral envelope, a mel-scale binary vector quantizer for obtaining a second residual spectral envelope represented with a linear scale code vector using a mel-scale binary vector codebook, a synthesized spectral envelope generator for adding the output of the predictive quantizer and the output of the mel-scale binary vector quantizer to generate a quantized residual spectral envelope and multiplying the quantized residual spectral envelope by a corresponding quantized linear prediction spectral envelope to generate a synthesized spectral envelope, a comparator for comparing the synthesized spectral envelope with an original spectral envelope, and a minimum value detector for detecting a minimum value from the values sequentially obtained by the comparator.

To achieve the second objective, there is provided a residual spectral envelope quantization apparatus in a variable dimension spectral magnitude quantization apparatus. The residual spectral envelope quantization apparatus includes a predictive quantizer for obtaining a predictive-quantized first residual spectral envelope from a quantized previous residual spectral envelope, a mel-scale binary vector quantizer for obtaining a second residual spectral envelope represented with a linear scale code vector using a mel-scale binary vector codebook, and a residual spectral envelope quantizer for adding the output of the predictive quantizer and the output of the mel-scale binary vector quantizer to generate a quantized residual spectral envelope. The mel-scale binary vector codebook is used for representing a residual spectral envelope of a variable high dimension as a code vector of a fixed low dimension.

To achieve the third objective, there is provided a residual spectral envelope quantization method including the steps of (a) obtaining a predictive-quantized first residual spectral envelope from a quantized previous residual spectral envelope, (b) obtaining a second residual spectral envelope represented with a linear scale code vector using a mel-scale binary vector codebook, and (c) adding the first residual spectral envelope and the second residual spectral envelope to generate a quantized residual spectral envelope. The mel-scale binary vector codebook is used for representing a residual spectral envelope of a variable high dimension as a code vector of a fixed low dimension.

To achieve the fourth objective, there is provided a variable dimension spectral magnitude quantization method including the steps of (a) obtaining a predictive-quantized first residual spectral envelope from a quantized previous residual spectral envelope, (b) obtaining a second residual spectral envelope represented with a linear scale code vector using a mel-scale binary vector codebook, (c) adding the first residual spectral envelope and the second residual spectral envelope to generate a quantized residual spectral envelope and multiplying the quantized residual spectral envelope by a corresponding quantized linear prediction spectral envelope to generate a synthesized spectral envelope, (d) comparing the synthesized spectral envelope with an original spectral envelope, and (e) detecting a minimum value from the values sequentially obtained in the step (d).

BRIEF DESCRIPTION OF THE DRAWINGS

The above objectives and advantages of the present invention will become more apparent by describing in detail a preferred embodiment thereof with reference to the attached drawings in which.

DETAILED DESCRIPTION OF THE INVENTION

In a sinusoidal speech coder, quantization of only a linear prediction (LP) spectral envelope is not enough to improve the performance when quantizing a spectral magnitude. Thus an algorithm for compensation is essentially desirable. The present invention relates to a scheme of quantizing an LP-spectral envelope and a residual spectral envelope using low order LP modeling and residual spectrum modeling. Particularly, the present invention performs predictive quantization of a residual spectral envelope using information on a previous frame and performs mel-scale binary vector quantization to solve the problem of the varying dimension of a spectrum.

Figure 1:
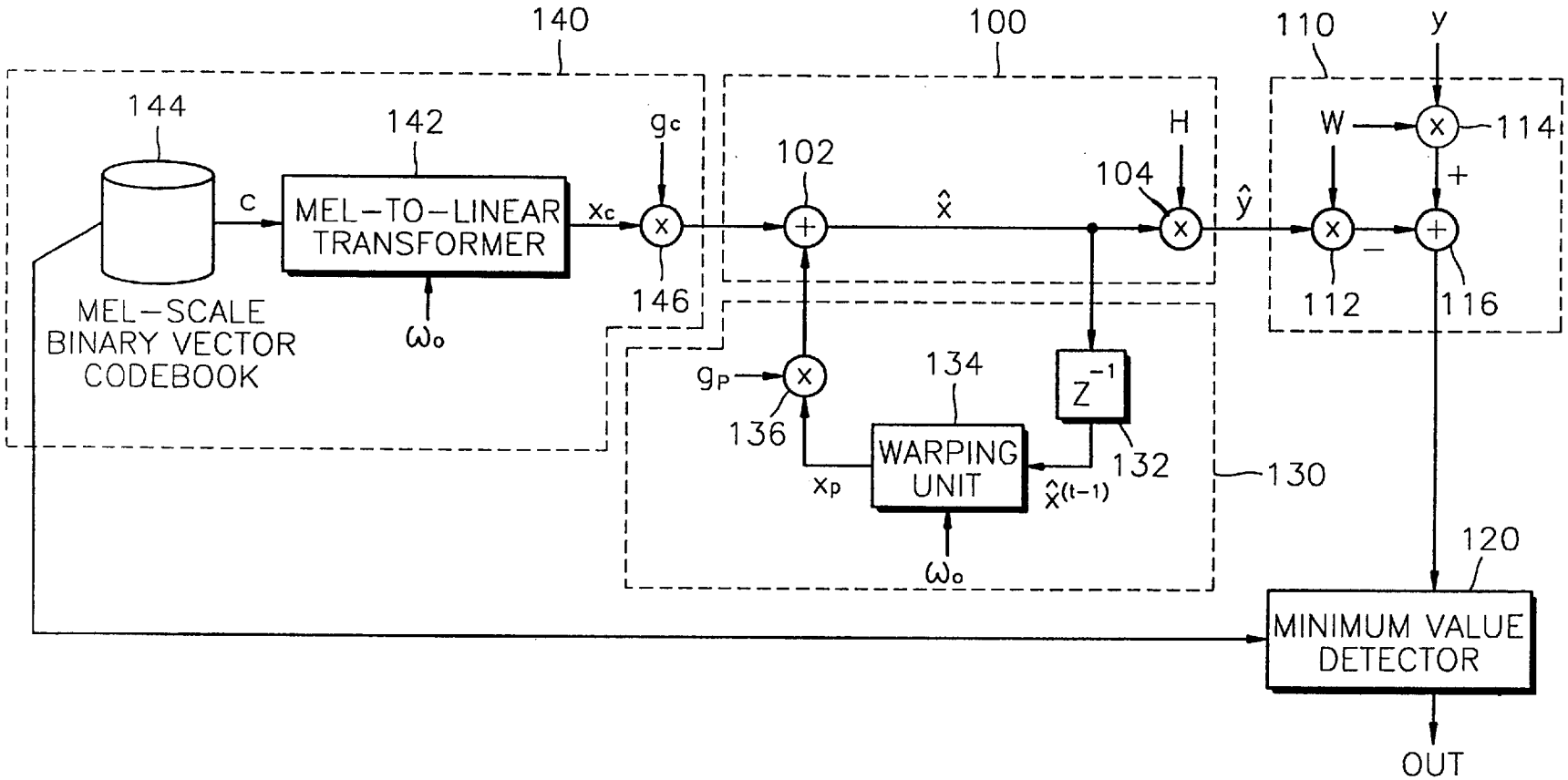
FIG. 1 is a block diagram of a variable dimension spectral magnitude quantization apparatus according to the present invention.

FIG. 1 is a block diagram of a variable dimension spectral magnitude quantization apparatus according to the present invention. The variable dimension spectral magnitude quantization apparatus includes a synthesized spectral envelope generator 100, a comparator 110, a minimum value detector 120, a predictive quantizer 130 and a mel-scale binary vector quantizer 140.

The spectral envelope y is modeled by multiplication of the LP-spectral envelop H and the residual spectral envelope x and expressed as y=Hx, where the diagonal elements of H are the magnitude of frequency response of a linear predictive coefficient (LPC) synthesis filter, and the dimensions of H, y and x are k×K, K×1 and K×1, respectively. K is determined by the fundamental frequency $\omega_0(K=\pi/\omega_0)$.

Referring to FIG. 1, the synthesized spectral envelope generator 100 outputs a synthesized spectral envelope $\hat{y}$ after a residual spectral envelope quantization according to the present invention. More specifically, a first adder 102 adds the output of the predictive quantizer 130 and the output of the mel-scale binary vector quantizer 140, which will be described later, and outputs a quantized residual spectral envelope $\hat{x}$. A first multiplier 104 multiplies the output of the first adder 102 and the quantized LP-spectral envelope H to model the synthesized spectral envelope $\hat{y}$ ($\hat{y}=H\hat{x}$).

The comparator 110 compares the synthesized spectral envelope $\hat{y}$ actually obtained after the quantization with the original spectral envelope y that is, a final target value. More specifically, a second multiplier 112 and a third multiplier 114 respectively multiply the synthesized spectral envelope $\hat{y}$ and the original spectral envelope y by a weighting factor W. The weighting factor W is determined by a known perceptual weighting method. A second adder 116 measures the difference between the synthesized spectral envelope $\hat{y}$ and the original spectral envelope y which are multiplied by the weighting factor W ($WH(x-\hat{x})$).

The minimum value detector 120 stores differences sequentially obtained by the comparator 110, detects a minimum value from the differences and transmits a codebook index corresponding to the minimum value in the mel-scale binary vector codebook 144 to a speech decoder. When $\hat{y}=H\hat{x}$ is represented by $\hat{y}=H(g_p x_p - g_c x_c)$, the minimum value is substantially measured using the following equation $$D=\|WH(x-g_p x_p-g_c x_c)\|^2, \tag{1}$$

where $g_p x_p$ and $g_c x_c$ are the outputs of the predictive quantizer 130 and the mel-scale binary vector quantizer 140, respectively.

The predictive quantizer 130 measures a predictive-quantized first residual spectral envelope from the quantized residual spectral envelope. More specifically, a buffer 132 receives and stores the quantized residual spectral envelope from the synthesized spectral envelope generator 100. A warping unit 134 obtains a predicted vector $x_p$ by linearly warping the synthesized residual vector of a previous residual spectral envelope $\hat{x}^{(t-1)}$ stored in the buffer 132. A fourth multiplier 136 multiplies the predicted vector $x_p$ by a predictive gain $g_p$ and outputs a result to the first adder 102.

The mel-scale binary vector quantizer 140 represents a residual spectral envelop to be quantized with a linear-scale code vector using a mel-scale binary vector codebook 144. More specifically, a mel-to-linear scale transformer 142 performs me-to-linear transformation with respect to the residual spectral envelope to obtain a linear-scale code vector $x_c$. A fifth multiplier 146 multiplies the linear-scale code vector $x_c$ by the gain $g_c$ of the code vector and outputs a result to the first adder 102.

Figure 2:
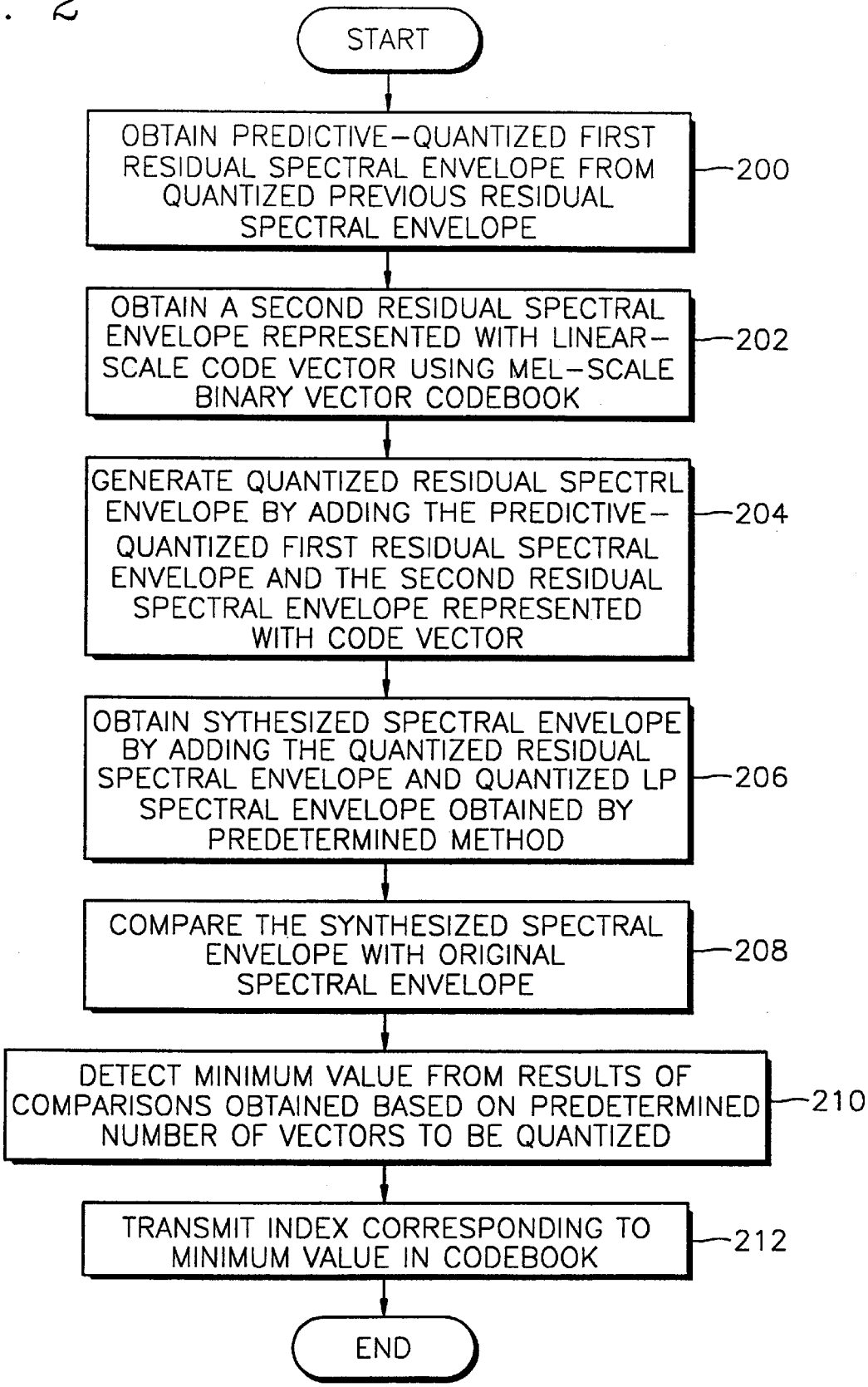
FIG. 2 is a flowchart for explaining a variable dimension spectral magnitude quantization method according to the present invention.

FIG. 2 is a flowchart for explaining a variable dimension spectral magnitude quantization method. With reference to FIG. 2, the operation of the apparatus of FIG. 1 will be described in detail.

From the observation of residual spectral envelopes, spectra slowly change from frame to frame. In other words, since a previous spectrum and a current spectrum slowly progress, the current spectrum can be partially predicted from the previous spectrum. Predictive coding in conjunction with residual spectral envelope coding is useful to reduce the number of bits for representing a spectral magnitude, rather than quantizing a residual spectral envelope directly or increasing the order of a LP model.

Depending on this characteristic, the method according to the present invention obtains a predictive-quantized first residual spectral envelope from a quantized previous residual spectral envelope in step 200. The predictive vector $x_p$ is obtained using the following equation $$x_p(k) = \hat{x}^{(t-1)}\left(\left\lfloor \frac{K^{(t-1)}}{K}k + 0.5 \right\rfloor\right), \quad 1 \le k \le K, \tag{2}$$

where $x_p(k)$ is the k-th element of $x_p$, $\hat{x}^{(t-1)}$ is the previous residual spectral envelope, k is the dimension of a residual spectral vector to actually be quantized, K is the whole dimension of a vector, that is, the number of current harmonics, and $K^{(t-1)}$ is the number of previous harmonics. Since the number of harmonics in a previous frame is different to the number of harmonics in a current frame, a process of converting the number of previous harmonics into the number of current harmonics is required. In other words, the K-dimensional predicted vector $x_p$ is obtained by linearly warping the synthesized residual vector of the $K^{(t-1)}$-dimensional previous residual spectral envelope.

The predictive gain $g_p$ is obtained using the following equation $$g_p = \frac{x_p^T H^T W^T W H x}{x_p^T H^T W^T W H x_p} \tag{3}$$

which is obtained when $D=\|WH(x-g_p x_p)\|^2$ is set to a minimum, that is, $\partial D/\partial g_p$ is set to 0. The predicted vector $x_p$ is multiplied by the predicted gain $g_p$ to obtain a final predictive-quantized first residual spectral envelope.

Next, a second residual spectral envelope represented with a linear-scale code vector is obtained using a mel-scale binary vector codebook in step 202. The residual spectral envelope, which defined as the difference between the original spectral envelope and a LP-and-predictive envelope, is considered for spectral compensation. The present invention proposes the mal-scale binary vector codebook for representing a residual spectral envelope of variable high dimension as a code vector of fixed low dimension. A mel-scale is a non-linear frequency scale on a frequency axis, which considers that the harmonic components of lower frequencies are perceptually more important than those of higher frequencies according to speech hearing characteristics. The harmonic components are split into mel-scale bands, and a binary vector is used for quantization of each band.

According to the mel-to-linear transformation, the k-th element of the linear-scale code vector $x_c$ is obtained from the m-th element of a mel-scale code vector c. This can be expressed as $$x_c(k) = c\left(\left\lfloor (M-1)\log_2\left(\frac{k-1}{K-1}+1\right)\right\rfloor\right), \quad 1 \le k \le K, \tag{4}$$

where M is the dimension of the mel-scale code vector c, k is the dimension of the residual spectral vector to be actually quantized, and K is the whole dimension of the vector, that is, the number of current harmonics. K varies depending on pitch. For example, if k is 1, $x_c(1)$ is c(0). If k is K, $x_c(K)$ is c(M−1). Each of the elements c(0), c(1), . . . , and c(M−1) of the code vector c is a binary number. m=0, 1, . . . , M−1 are indexes of the codebook and a value corresponding to an index is found in the codebook.

This transformation generates a variable-dimension vector from a fixed-dimension code vector. The fixed-dimension of the code vector is relatively low, e.g., 10, 12 or 14, compared with the number of harmonics, which generally ranges from 10 to 70. Hence, it is possible to generate the varying K-dimensional code vector $x_c$ from the M-dimensional fixed code vector c by the mel-to-linear transformation.

An optimal code vector c* for the elements c(0), . . . or c(M−1) obtained from the equation (4) can be obtained using the following equation $$c^* = \arg\max_{c\in\Omega} \frac{((x^T - g_p x_p^T)H^T W^T W H x_c)^2}{x_c^T H^T W^T W H x_c}, \tag{5}$$

where Ω represents the set of code vectors in the mel-scale binary vector codebook and is composed of $2^M$ code vectors. The optimal gain $g_c$ of the optimal code vector can be expressed as the following equation. The final residual spectral envelope which is mel-scale binary vector quantized is obtained by multiplying the linear-scale code vector $x_c$ obtained through the equation (4) by the gain $g_c$ of the code vector as $$g_c = \frac{(x^T - g_p x_p^T)H^T W^T W H x}{x_{c^*}^T H^T W^T W H x_{c^*}}. \tag{6}$$

Referring back to FIG. 2, in step 204, the predictive-quantized first residual spectral envelope obtained in the step 200 is added to the second residual spectral envelope, which is represented with the code vector and obtained in the step 202, to generate a quantized residual spectral envelope. Subsequently, in step 206, the quantized residual spectral envelope is added to a quantized LP spectral envelope obtained using a predetermined method to obtain a synthesized spectral envelope. Quantization of the LP spectral envelope is not considered in the present invention.

Next, the synthesized spectral envelope is compared with the original spectral envelope in step 208. After as many comparisons as a predetermined number of vectors to be quantized are performed, a minimum value is detected from the results of the comparisons obtained in units of the predetermined number of vectors in step 210. Finally, an index corresponding to the minimum value in the codebook is transmitted to a coder in step 212.

Most amount of the computation performed during the quantization according to the present invention is caused by the computation of the optimal code vector c*. A closed-loop search method of computing the optimal code vector using the equation (5) and finding a corresponding code vector in the binary codebook, needed the amount of computation of about 500 wMOPS in a test. The amount of computation must be 20–30 wMOPS to obtain a standard speech coder which is of practical use. Accordingly, a method for remarkably reducing the amount of computation is desired. The present invention proposes an open-loop search method for the binary codebook, which reduces the amount of computation to be less than 1 WMOPS as follows.

If the binary code value found as one corresponding to $x_c(k)$ in the binary vector codebook is +1 or −1, the equation (5) can be expressed as $$c^* = \arg\max_{c\in\Omega}((x^T - g_p x_p^T)H^T W^T W H x_c)^2, \tag{7}$$

where $x_c^2(k)=1$ for $1 \leqq k \leqq K$, and finally $x_p^T H^T W^T W H x_c$ becomes constant.

Furthermore, the equation (7) can be represented as $$c^* = \arg\max_{c\in\Omega}(d^T x_c)^2, \text{ where } d = H^T W^T W H(x - g_p x_p). \tag{8}$$

The maximum value of the equation (8) can be found as $$\sum_{m=0}^{M-1}\left(c(m)\sum_{k=l_m}^{u_m} d(k)\right)^2 \le \sum_{m=0}^{M-1}\left|\sum_{k=l_m}^{u_m} d(k)\right|^2, \tag{9}$$

where c(m)=±1, d(k) is the k-th element of the vector d, and $l_m$ and $u_m$ are the lower and the upper harmonic bounds of the sub-band of the m-th element of the mel-scale code vector c, respectively. Hence, the optimal code vector c* satisfying the equation (9) can be expressed as $$c^*(m) = \begin{cases} 1 & \text{if } \sum_{k=l_m}^{u_m} d(k) \rangle 0, \quad 0 \le m \le M-1, \\ -1 & \text{elsewhere,} \end{cases} \tag{10}$$

where c*(m) is the m-th element of the optimal code vector c*.

The present invention performs spectral magnitude quantization with a very small memory requirement and a small amount of computation by obtaining the optimal code vector c* according to the open-loop search method using the equation (10) without a trained codebook.

Figure 3A:
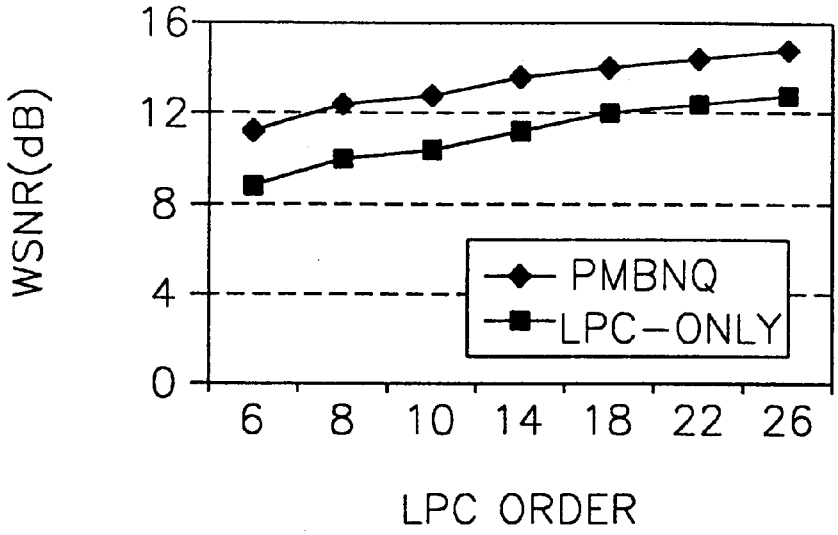
FIGS. 3A and 3B are diagrams for comparing the performance of the present invention with the performance of prior art.
Figure 3B:
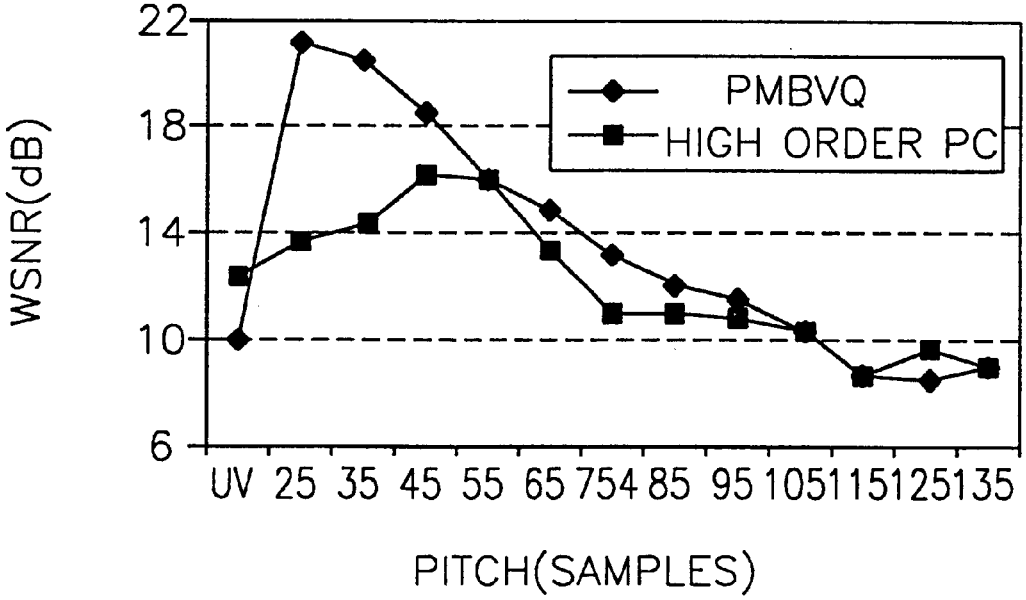

FIGS. 3A and 3B are diagrams for comparing the performance of the present invention with the performance of prior art. Performance is evaluated based on weighted signal to noise ratio (WSNR) in a spectral domain defined as $$WSNR(\text{dB}) = 10\log\frac{y^T W^T W y}{(y-\hat{y})^T W^T w(y-\hat{y})}, \tag{11}$$

$$\text{where } \hat{y} = g_p H x_p + g_c H x_c,$$

In FIG. 3A, predictive and mel-scale binary vector quantization, in conjunction with the order of LPC according to the present invention, is superior to conventional quantization using only a LP spectrum model at the point of WSNR with respect to the LPC order. Here, the dimension of a mel-scale code vector, M, is set to 12. In FIG. 3B, the quantization according to the present invention is also superior to conventional quantization using high order LP spectrum modeling at the point of WSNR with respect to pitch.

As described above, the variable dimension spectral magnitude quantization apparatus and method according to the present invention solves a problem of the varying dimension of a spectrum using a predictive codebook and efficiently quantizes a residual spectral envelope by splitting harmonic components into mel-scale bands and applying a predictive codebook and a binary codebook, thereby remarkably improving speech quality and reducing the computational complexity and memory requirements.

What is claimed is:

1. A variable dimension spectral magnitude quantization apparatus according to linear prediction spectral envelope and residual spectral envelope quantization using low order linear prediction modeling and residual spectrum modeling, the apparatus comprising:

a predictive quantizer for obtaining a predictive-quantized first residual spectral envelope from a quantized previous residual spectral envelope;

a mel-scale binary vector quantizer for obtaining a second residual spectral envelope represented with a linear scale code vector using a mel-scale binary vector codebook;

a synthesized spectral envelope generator for adding the output of the predictive quantizer and the output of the mel-scale binary vector quantizer to generate a quantized residual spectral envelope and multiplying the quantized residual spectral envelope by a corresponding quantized linear prediction spectral envelope to generate a synthesized spectral envelope;

a comparator for comparing the synthesized spectral envelope with an original spectral envelope; and a minimum value detector for detecting a minimum value from the values sequentially obtained by the comparator.

2. The variable dimension spectral magnitude quantization apparatus of claim 1, wherein the predictive quantizer comprises:

a buffer for receiving and storing a quantized residual spectral envelope from the synthesized spectral envelope generator;

a warping unit for linearly warping the synthesized residual vector of a previous residual spectral envelope stored in the buffer to obtain a predicted vector; and a multiplier for multiplying the predicted vector by a corresponding predictive gain.

3. The variable dimension spectral magnitude quantization apparatus of claim 1, wherein the mel-scale binary vector quantizer comprises:

a mel-to-linear transformer for performing mel-to-linear transformation with respect to the residual spectral envelope using the mel-scale binary vector codebook to obtain the linear-scale code vector; and a multiplier for multiplying the linear-scale code vector by a corresponding predictive gain, wherein the mel-scale binary vector codebook is used for representing a residual spectral envelope of a variable high dimension as a code vector of a fixed low dimension.

4. A residual spectral envelope quantization apparatus in a variable dimension spectral magnitude quantization apparatus, comprising:

a predictive quantizer for obtaining a predictive-quantized first residual spectral envelope from a quantized previous residual spectral envelope;

a mel-scale binary vector quantizer for obtaining a second residual spectral envelope represented with a linear scale code vector using a mel-scale binary vector codebook; and a residual spectral envelope quantizer for adding the output of the predictive quantizer and the output of the mel-scale binary vector quantizer to generate a quantized residual spectral envelope, wherein the mel-scale binary vector codebook is used for representing a residual spectral envelope of a variable high dimension as a code vector of a fixed low dimension.

5. A residual spectral envelope quantization method in variable dimension spectral magnitude quantization, comprising the steps of:

(a) obtaining a predictive-quantized first residual spectral envelope from a quantized previous residual spectral envelope;

(b) obtaining a second residual spectral envelope represented with a linear scale code vector using a mel-scale binary vector codebook; and (c) adding the first residual spectral envelope and the second residual spectral envelope to generate a quantized residual spectral envelope, wherein the mel-scale binary vector codebook is used for representing a residual spectral envelope of a variable high dimension as a code vector of a fixed low dimension.

6. The residual spectral envelope quantization method of claim 5, wherein, in the step (a), a predicted vector $x_p$ is obtained using $$x_p(k) = \hat{x}^{(t-1)}\left(\left\lfloor \frac{K^{(t-1)}}{K}k + 0.5 \right\rfloor\right), \quad 1 \le k \le K,$$

where $x_p(k)$ is the k-th element of $x_p$, $\hat{x}^{(t-1)}$ is a previous residual spectral envelope, k is the dimension of a residual spectral vector to actually be quantized, K is the number of current harmonics, and $K^{(t-1)}$ is the number of previous harmonics.

7. The residual spectral envelope quantization method of claim 6, wherein, in the step (a), a predictive gain is obtained using $$g_p = \frac{x_p^T H^T W^T W H x}{x_p^T H^T W^T W H x_p},$$

where H is a spectral envelope corresponding to the quantized residual spectral envelope obtained in the step (c) and W is a weighting factor, and the predictive-quantized first residual spectral envelope $g_p x_p$ is obtained by multiplying the predicted vector by the predictive gain.

8. The residual spectral envelope quantization method of claim 5, wherein, in the step (b), the k-th element of the linear-scale code vector $x_c$ is obtained from the m-th element of a mel-scale code vector c with reference to the mel-scale binary vector codebook as $$x_c(k) = c\left(\left\lfloor (M-1)\log_2\left(\frac{k-1}{K-1}+1\right)\right\rfloor\right), \quad 1 \le k \le K,$$

where M is the dimension of the mel-scale code vector c, k is the dimension of a residual spectral vector to be actually quantized, and K is the number of current harmonics.

9. The residual spectral envelope quantization method of claim 8, wherein, in the step (b), the gain $g_c$ of the linear-scale code vector is obtained using $$g_c = \frac{(x^T - g_p x_p^T) H^T W^T W H x}{x_{c*}^T H^T W^T W H x_{c*}},$$

where $g_p x_p$ is the predictive-quantized first residual spectral envelope obtained in the step (a), H is a linear prediction spectral envelope corresponding to the quantized residual spectral envelope obtained in the step (c), and W is a weighting factor, and the finally mel-scale binary vector quantized residual spectral envelope $g_c x_c$ is obtained by multiplying the linear-scale code vector by the gain of the code vector.

10. The residual spectral envelope quantization method of claim 8, wherein, in the step (b), if a binary code value found as one corresponding to the k-th element of the linear-scale code vector $x_c$, $x_c(k)$, in the mel-scale binary vector codebook is +1 or −1, the m-th element of an optimal code vector c* with respect to the mel-scale code vector c, c*(m), is expressed as $$c^*(m) = \begin{cases} 1 & \text{if } \sum_{k=l_m}^{u_m} d(k) \geq 0, \\ -1 & \text{elsewhere,} \end{cases} \quad 0 \le m \le M-1,$$

where M is the dimension of the mel-scale code vector c, d(k) is the k-th element of the vector d, $d = H^T W^T W H(x - g_p x_p)$, and $l_m$ and $u_m$ are the lower and the upper harmonic bounds of the sub-band of the m-th element of the mel-scale code vector c, respectively.

11. A variable dimension spectral magnitude quantization method using low order linear prediction modeling and residual spectrum modeling according to linear prediction spectral envelope and residual spectral envelope quantization, the method comprising the steps of:

(a) obtaining a predictive-quantized first residual spectral envelope from a quantized previous residual spectral envelope;

(b) obtaining a second residual spectral envelope represented with a linear scale code vector using a mel-scale binary vector codebook;

(c) adding the first residual spectral envelope and the second residual spectral envelope to generate a quantized residual spectral envelope and multiplying the quantized residual spectral envelope by a corresponding quantized linear prediction spectral envelope to generate a synthesized spectral envelope;

(d) comparing the synthesized spectral envelope with an original spectral envelope; and (e) detecting a minimum value from the values sequentially obtained in the step (d).

* * * * *